US011426750B2

(12) United States Patent
Ikushima

(10) Patent No.: US 11,426,750 B2
(45) Date of Patent: Aug. 30, 2022

(54) LIQUID MATERIAL DISCHARGE DEVICE WITH TEMPERATURE CONTROL DEVICE, APPLICATION DEVICE FOR SAME, AND APPLICATION METHOD

(71) Applicant: MUSASHI ENGINEERING, INC., Mitaka (JP)

(72) Inventor: Kazumasa Ikushima, Tokyo (JP)

(73) Assignee: MUSASHI ENGINEERING, INC., Mitaka (JP)

( * ) Notice: Subject to any disclaimer, the term of this patent is extended or adjusted under 35 U.S.C. 154(b) by 525 days.

(21) Appl. No.: 16/339,556

(22) PCT Filed: Oct. 5, 2017

(86) PCT No.: PCT/JP2017/036337
§ 371 (c)(1),
(2) Date: Apr. 4, 2019

(87) PCT Pub. No.: WO2018/066660
PCT Pub. Date: Apr. 12, 2018

(65) Prior Publication Data

US 2020/0038894 A1 Feb. 6, 2020

(30) Foreign Application Priority Data

Oct. 7, 2016 (JP) ..... JP2016-198746

(51) Int. Cl.
*B05C 11/10* (2006.01)
*B05B 12/10* (2006.01)
(Continued)

(52) U.S. Cl.
CPC ..... *B05B 12/10* (2013.01); *B05C 5/00* (2013.01); *B05B 1/14* (2013.01); *B05C 11/1015* (2013.01); *B05D 1/26* (2013.01); *B05D 3/00* (2013.01)

(58) Field of Classification Search
None
See application file for complete search history.

(56) References Cited

U.S. PATENT DOCUMENTS

2012/0081455 A1* 4/2012 Kritchman ..... B05C 11/10 347/20
2016/0183409 A1* 6/2016 Zhou ..... H05K 7/20927 361/699
2017/0066005 A1 3/2017 Ikushima

FOREIGN PATENT DOCUMENTS

JP 9-73977 A 3/1997
JP 2005-111446 A 4/2005
(Continued)

OTHER PUBLICATIONS

English translation of JP5256717 corresponding to JP2009-136799.*
(Continued)

*Primary Examiner* — Charles Capozzi
(74) *Attorney, Agent, or Firm* — WHDA, LLP

(57) ABSTRACT

Application of liquid material is carried out without causing variations in discharge amount even on a stage under heating while temperature of a liquid material is adjusted by a temperature control device. A liquid material discharge device includes a discharge port, a liquid chamber in communication with the discharge port, and a temperature control device adjusting a temperature of the liquid chamber, the liquid material discharge device discharging the liquid material from the discharge port while a workpiece and the discharge port are moved relative to each other. The liquid material discharge device also includes a coolant flow path through which a coolant for heat exchange with the temperature control device flows, and a discharge control device controlling a discharge operation. An application device including the liquid material discharge device and an appli-
(Continued)

cation method using the application device are also provided.

30 Claims, 14 Drawing Sheets

(51) Int. Cl.

| | |
|---|---|
| ***B05C 5/00*** | (2006.01) |
| *B05B 1/14* | (2006.01) |
| *B05D 1/26* | (2006.01) |
| *B05D 3/00* | (2006.01) |

(56) References Cited

FOREIGN PATENT DOCUMENTS

| | | | |
|---|---|---|---|
| JP | 2005-211874 | A | 8/2005 |
| JP | 2005-270878 | A | 10/2005 |
| JP | 2009-136799 | A | 6/2009 |
| JP | 2013-150988 | A | 8/2013 |
| JP | 5465846 | B2 | 4/2014 |
| JP | 2016-159213 | A | 9/2016 |
| WO | 2015/137271 | A1 | 9/2015 |

OTHER PUBLICATIONS

Supplementary European Search Report dated May 11, 2020, issued in counterpart EP Application No. 17858496.7. (1 page).

International Search Report dated Apr. 12, 2018, issued in counterpart International Application No. PCT/JP2017/036337. (3 pages).

Translation of the International Prelimincation Reporton Patentability (Form PCT/IPEA/409) issued in counterpart International Application No. PCT/JP2017/036337 dated Apr. 7, 2019. (9 pages).

Office Action dated Mar. 16, 2021, issued in counterpart JP Application No. 2018-543969, with English Translation. (12 pages).

Office Action dated Nov. 11, 2021, issued in counterpart KR application No. 10-2019-7010018, with English translation. (8 pages).

* cited by examiner

Fig. 12 (a)
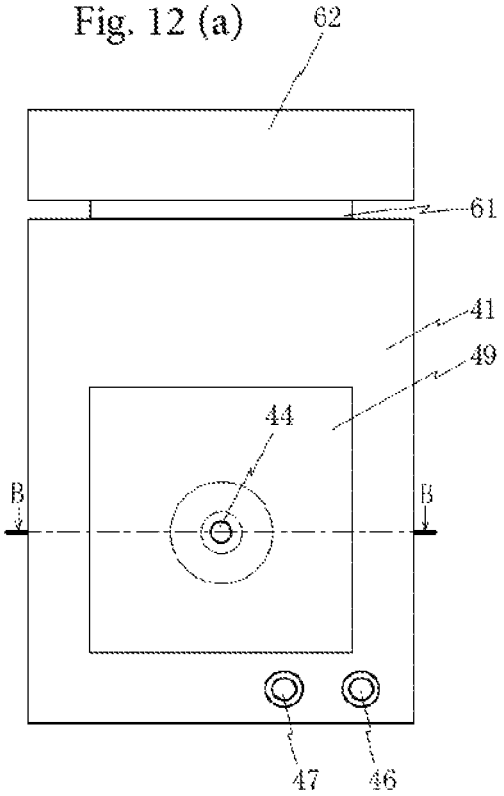
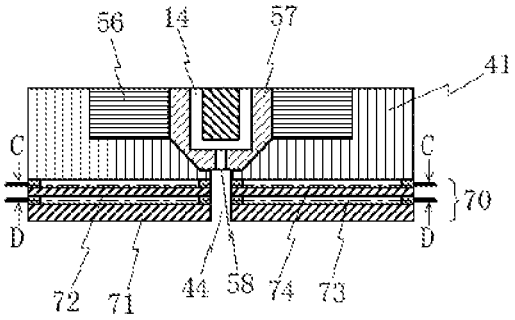
Fig. 12 (b)
Fig. 12 (c)
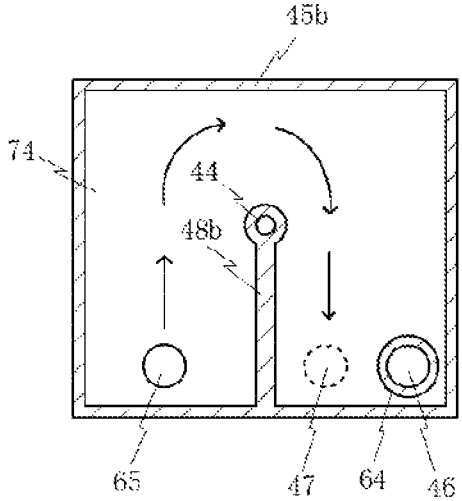
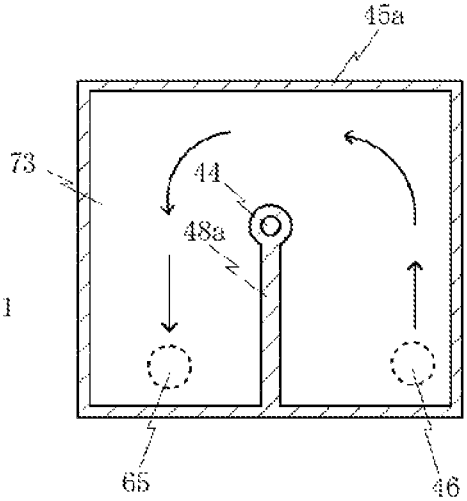
Fig. 12 (d)

LIQUID MATERIAL DISCHARGE DEVICE WITH TEMPERATURE CONTROL DEVICE, APPLICATION DEVICE FOR SAME, AND APPLICATION METHOD

TECHNICAL FIELD

The present invention relates to a liquid material discharge device with a temperature control device, an application device including the discharge device, and an application method using the application device. More particularly, the present invention relates to a liquid material discharge device in which temperature of a liquid material can be accurately adjusted even when discharge work is performed in two or more work environments much different in temperature from one another, an application device including the discharge device, and an application method using the application device. In this Description, the meaning of the word "air" is not limited to the atmosphere, and the word "air" used here has the meaning including another type of gas (e.g., nitrogen gas) as well. Furthermore, in this Description, the term "heat source" is used as meaning both of a heating source and a cold source.

BACKGROUND ART

When mounting a semiconductor chip by the flip chip method, an underfill step is performed to fill a resin 4 into a gap between a semiconductor chip 5 and a substrate 2 and to reinforce a connecting portion 3 (see FIG. 15) for the purpose of preventing stress, which is generated due to the difference in thermal expansion coefficient between the semiconductor chip and the substrate, from concentrating at the connecting portion and damaging the connecting portion. The underfill step is performed by applying the resin 4 in a liquid state along an outer periphery of the semiconductor chip 5, causing the resin 4 to be filled into the gap between the semiconductor chip 5 and the substrate 2 with the capillary action, and then heating the resin 4 in an oven, for example, to solidify the resin.

Recently, with further reduction in size and thickness of products, sizes and thicknesses of the semiconductor chip 5 and the substrate 2 themselves used in the flip chip method have also been reduced. The semiconductor chip 5 and the substrate 2 having smaller sizes and thicknesses are easier to conduct heat therethrough and are more susceptible to ambient temperature. Therefore, the connecting portion 3 is more easily damaged by the stress generated as described above. In such a situation, heating the substrate is proposed to reduce viscosity of the resin and to facilitate the filling of the resin with intent to ensure reinforcement obtained with the underfill step.

For example, Patent Document 1 discloses a substrate heating device for heating a substrate by spraying heated gas, the substrate heating device comprising a heating unit including a projection that projects upward toward a bottom surface of the substrate, and further including a gas flow path having one end in communication with a blow-off hole opened at an upper surface of the projection and the other end in communication with a gas supply unit; gas heating means heating gas that flows in the gas flow path; an on-off valve turning on or off a flow of the gas supplied to the gas flow path; and a valve control unit controlling opening and closing operations of the on-off valve to heat the substrate to a target temperature.

In the substrate heating device in which the substrate is heated only during the application, however, because the substrate is in a non-heated state when it is conveyed before and after the application, temperature change between during the application and during the conveyance is increased, and change of the above-described stress generated due to the difference in thermal expansion coefficient is also increased. This raises a problem that the connecting portion tends to be damaged.

To cope with the above problem, the applicant has proposed a substrate heating device capable of preventing damage of a connecting portion by reducing, during a time span including periods before and after application work, temperature change of a substrate on which a semiconductor chip is placed, the substrate heating device heating, from below, the substrate conveyed in one direction and including a workpiece which is disposed on the substrate and on which the application work is carried out during the conveyance, wherein the substrate heating device includes a heating member that is held in contact with a bottom surface of the substrate, and that includes a flat upper surface heating the substrate and jet openings formed in the upper surface and allowing heating gas to be jetted out therethrough toward the bottom surface of the substrate, and an elevating mechanism that elevates and lowers the heating member (see Patent Document 2).

CITATION LIST

Patent Documents

Patent Document 1: Japanese Patent Laid-Open Publication No. 2005-211874

Patent Document 2: Japanese Patent No. 5465846

SUMMARY OF INVENTION

Technical Problem

Because characteristics, such as viscosity, of the liquid material are different depending on temperature, the application work is carried out in some cases while the temperature of the liquid material is controlled by the temperature control device.

However, when the application work is carried out on a stage under heating, there is a problem that the temperature control device is excessively heated by radiant heat from the stage and temperature control is difficult to perform.

Another problem is that, when the application work is carried out at two places where temperature environments are much different from each other, the temperature control device cannot be adapted for the temperature environments and variations generate in discharge amount. For instance, when the application work is carried out on a stage heated to high temperature and a discharge amount is then measured by a weighting device outside the stage, there is a problem that discharge on the stage cannot be reproduced in the weighting device and accurate correction cannot be performed.

In view of the above-described situations, an object of the present invention is to provide a device and a method with which application work can be carried out without causing variations in discharge amount while temperature of a liquid material is adjusted by a temperature control device, even when the application work is performed in two or more work environments much different in temperature from one another.

Solution to Problem

A liquid material discharge device according to the present invention comprises a discharge port, a liquid chamber in communication with the discharge port, and a discharge control device controlling a discharge operation, the liquid material discharge device discharging the liquid material from the discharge port while a workpiece and the discharge port are moved relative to each other, wherein the liquid material discharge device further comprises a heat-transfer temperature control device including a heat source to adjust a temperature of the liquid chamber, and a heat-shield temperature control device disposed between the heat-transfer temperature control device and the workpiece, and adjusting a temperature of the heat-transfer temperature control device.

In the above-described liquid material discharge device, the heat-shield temperature control device may include a heat-exchange flow path through which a heat-exchange fluid flows.

In the above-described liquid material discharge device, the heat-transfer temperature control device may include a heat conduction member conducting heat from the heat source to the liquid chamber, and the heat conduction member may be a temperature control jacket covering a periphery of the liquid chamber.

The above-described liquid material discharge device may further comprise a nozzle member including the discharge port formed at a lower end thereof, wherein the temperature control jacket may include a discharge hole through which the nozzle member is inserted, or through which the discharge port and an outside are communicated with each other.

In the above-described liquid material discharge device, a bottom surface of the temperature control jacket may constitute at least part of an inner wall of the heat-exchange flow path.

In the above-described liquid material discharge device, the heat-shield temperature control device may include a heat shield member blocking radiant heat from the side including the workpiece. The heat shield member may reflect an infrared ray in a particular wavelength range.

In the above-described liquid material discharge device including the heat shield member, the heat shield member may constitute at least part of an inner wall of the heat-exchange flow path.

In the above-described liquid material discharge device including the heat shield member, the heat shield member may have a bottom area equal to or larger than a bottom surface of the temperature control jacket, and may be disposed in a covering relation to the bottom surface of the temperature control jacket when viewed from the bottom surface side.

In the above-described liquid material discharge device including the heat shield member, the heat shield member may include a rising portion covering a lateral surface of the heat-exchange flow path.

In the above-described liquid material discharge device including the heat shield member, an infrared reflection layer made of a metal surface reflecting an infrared ray in a particular wavelength range or a coating film surface reflecting the infrared ray in the particular wavelength range may be formed at a bottom surface of the heat shield member.

In the above-described liquid material discharge device including the heat shield member having the metal surface or the coating film surface, the heat shield member may be made of a material having a higher thermal conductivity than the bottom surface of the temperature control device and may include a heat transfer layer constituting an inner wall of the coolant flow path.

In the above-described liquid material discharge device including the heat transfer layer, the heat shield member may include a heat insulating layer disposed between the heat transfer layer and the bottom surface and made of a material having a higher thermal conductivity than the bottom surface.

In the above-described liquid material discharge device including the heat shield member that includes the heat insulating layer, the heat insulating layer may be made of resin.

In the above-described liquid material discharge device including the heat shield member, the heat shield member may include a plate-like member disposed with a gap interposed between the plate-like member and the bottom surface of the temperature control jacket, and the heat-exchange flow path may be formed by the gap.

In the above-described liquid material discharge device including the heat shield member, the heat shield member may include a first plate-like member disposed with a gap interposed between the first plate-like member and the bottom surface of the temperature control jacket, and a second plate-like member disposed with a gap interposed between the second plate-like member and a bottom surface of the first plate-like member, and the heat-exchange flow path may include an upper heat-exchange flow path formed by a space between the bottom surface of the temperature control jacket and an upper surface of the first plate-like member, and a lower heat-exchange flow path formed by a space between the bottom surface of the first plate-like member and an upper surface of the second plate-like member. The heat shield member may include a communication tube through which the coolant is supplied to the lower heat-exchange flow path, and a communication hole through which the heat-exchange fluid having passed through the lower heat-exchange flow path is supplied to the upper heat-exchange flow path.

In the above-described liquid material discharge device, an infrared reflection layer made of a metal surface reflecting an infrared ray in a particular wavelength range or a coating film surface reflecting the infrared ray in the particular wavelength range may be formed at the bottom surface of the temperature control jacket.

The above-described liquid material discharge device may further comprise a heat-exchange fluid delivery device that supplies the heat-exchange fluid to the heat-exchange flow path.

In the above-described liquid material discharge device including the heat-exchange fluid delivery device, the heat-exchange fluid delivery device may be constituted by an air supply source supplying pressurized air.

In the above-described liquid material discharge device including the heat-exchange fluid delivery device, the heat-exchange fluid delivery device may be constituted by a circulation pump supplying the heat-exchange fluid in a circulating way.

In the above-described liquid material discharge device, the heat-shield temperature control device may include a temperature sensor measuring a temperature of the temperature control jacket, and the discharge control device may control a flow rate of the heat-exchange fluid flowing through the heat-exchange flow path in accordance with a signal from the temperature sensor.

The above-described liquid material discharge device may further comprise a supply flow path through which the liquid material is supplied to the liquid chamber, wherein the heat-transfer temperature control device is disposed in a covering relation to the liquid chamber and the supply flow path.

The above-described liquid material discharge device may further comprise a plunger including a tip portion that is narrower than the liquid chamber and that is disposed in the liquid chamber, and a plunger driver moving the plunger forward and backward, wherein the liquid material discharge device may be a jet discharge device in which the liquid material is discharged in the form of flying droplets from the discharge port by causing the plunger moving forward to collide against a valve seat formed in an inner bottom surface of the liquid chamber, or by stopping the plunger moving forward immediately before colliding against the valve seat.

An application device according to the present invention comprises the above-described liquid material discharge device, a stage on which the workpiece is placed, a heater heating the stage, a relative moving device moving the liquid material discharge device and the stage relative to each other, and a drive control device controlling the relative moving device.

In the above-described application device, the heater may have an ability of heating the stage to temperature higher than a room temperature by 20° C. or more, and the heat-transfer temperature control device may adjust a temperature of the liquid chamber to be kept within a range of ±10° C. from the room temperature.

An application method according to a first aspect of the present invention is an application method using the above-described application device that includes the heater with the ability of heating the stage to temperature higher than a room temperature by 20° C. or more, wherein the heat-exchange fluid is a coolant at temperature not higher than the room temperature, and the liquid material is applied in a state in which the stage is heated by the heater to temperature higher than the room temperature by 20° C. or more.

An application method according to a second aspect of the present invention is an application method using the above-described liquid material discharge device, wherein the application method comprises a first application step of performing first application under a first temperature environment, and a second application step of performing second application under a second temperature environment that is different in temperature from the first temperature environment by 10° C. or more.

An application method according to a third aspect of the present invention is an application method using the above-described application device, wherein the application method comprises a step of performing first application on the stage under heating, and a step of performing second application outside the stage.

Advantageous Effect of Invention

According to the present invention, even when application work is carried out in two or more work environments much different in temperature from one another, the application work can be carried out without causing variations in discharge amount while the temperature of the liquid material is adjusted by the temperature control device.

BRIEF DESCRIPTION OF THE DRAWINGS

FIG. 12(*a*) is a horizontal sectional view of a temperature control device unit according to a sixth embodiment, FIG. 12(*b*) is a partially sectional front view, FIG. 12(*c*) is a sectional view taken along C-C, and FIG. 12(*d*) is a sectional view taken along D-D.

DESCRIPTION OF EMBODIMENTS

Operation of the discharge device 1 according to the present invention will be described below with reference to FIG. 1.

Figure 1A:
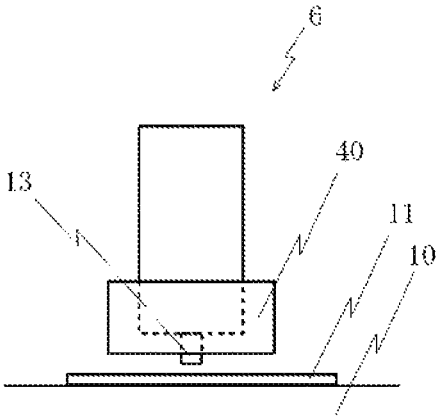
FIG. 1(*a*) is an explanatory view referenced to explain an application operation of a known discharge device, and FIG. 1(*b*) is an explanatory view referenced to explain an application operation of a discharge device according to the present invention.
Figure 1B:
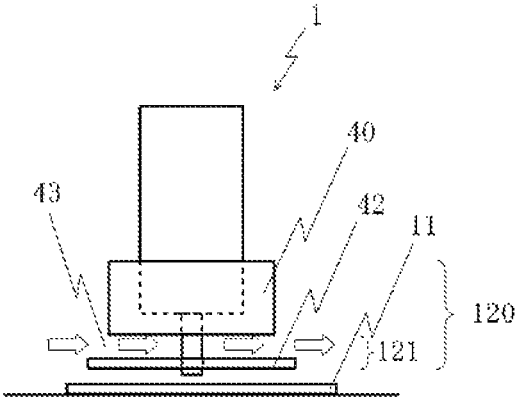

FIG. 1(*a*) is an explanatory view referenced to explain an application operation of a known discharge device 6. The known discharge device 6 is equipped with a temperature control device 40 including a heat source and a heat transfer member for transferring heat from the heat source to a liquid chamber. In the known discharge device 6, application of a liquid material for drawing a desired pattern is performed by discharging the liquid material from a nozzle member 13 while a workpiece 11 placed on a stage 10 and the nozzle member 13 are moved relative to each other. When the stage 10 is heated to high temperature (e.g., 60 to 100° C.), the temperature control device 40 is heated by radiant heat from the stage 10 and the workpiece 11. Therefore, if the application operation is performed for a long time, a difficulty occurs in controlling the temperature by the temperature control device 40, and the temperature of the liquid material can no longer be controlled. Thus, there has been a problem (first problem) that, as a result of excessive heating, viscosity of the liquid material is changed and the liquid material cannot be discharged in a desired amount with high accuracy. The first problem becomes more significant especially when the difference in temperature between the stage 10 and control temperature of the liquid material exceeds several tens ° C. The temperature control device 40 corresponds to a heat-transfer temperature control device, described later, in the present invention, and it has a capability of adjusting the temperature of the liquid material, which is discharged from the nozzle member 13, to be kept constant in an environment where the stage 10 is not heated. The heat source in the temperature control device 40 may have both the functions of heating and cooling, or may have only one of the functions of heating and cooling.

When application work is carried out continuously for a certain time or longer, change in viscosity of the liquid material with the lapse of time has to be taken into consideration. In the underfill step, for example, if the viscosity increases, a discharge amount from a material discharge port decreases and the capillary action becomes insufficient, thus causing a problem that an appropriate amount of the material cannot be filled into the above-described gap. To cope with such a problem, it has been required to move the discharge device 1 to a position above a weighing device outside the stage, to measure the weight of the liquid material discharged for a certain time, and to correct change of the discharge amount attributable to the viscosity change with the lapse of time.

However, when the discharge device 1 is moved to the position outside the stage where there is no radiant heat, the temperature of the liquid material is lowered, thus causing a problem (second problem) that the discharge amount cannot be measured under the same condition as that on the stage.

Heating the weighing device outside the stage is conceivable to solve the second problem, but such a solution raises a problem (third problem) that a pot life of the liquid material is shortened under high temperature. For instance, when an insulating resin added with a thermosetting agent is used for the so-called potting, the usable time of a potting material is shortened because a thermosetting reaction of the thermosetting agent progresses.

FIG. 1(*b*) is an explanatory view referenced to explain an application operation of a discharge device 1 according to the present invention. The discharge device 1 includes a heat shield member 42 disposed between a stage 10 and a temperature control device 40 (heat-transfer temperature control device), and a heat-exchange flow path (coolant flow path) 43 for heat exchange with the temperature control device 40. Thus, the discharge device 1 according to the present invention is featured in including, in addition to the heat-transfer temperature control device 40, a heat-shield temperature control device (42, 43) disposed between the heat-transfer temperature control device 40 and a workpiece 11. In the following, the heat-transfer temperature control device and the heat-shield temperature control device constituted integrally with each other is called a temperature control device unit 120 in some cases. Although FIG. 1(*b*) illustrates a heat-shield temperature control device including both the heat shield member 42 and the heat-exchange flow path 43, the heat-shield temperature control device may be constituted as a device including either one of the heat shield member 42 and the heat-exchange flow path 43. The discharge device 1 according to the present invention has an advantageous effect that, because radiant heat from the stage 10 and the workpiece 11 is blocked off by the heat shield member 42, the temperature control device 40 can be prevented from being heated excessively. When the discharge device 1 is used for a long time, the heat shield member 42 is also heated by the above-mentioned radiant heat, and the temperature control device 40 is further heated by radiant heat from the heat shield member 42. However, because the heated temperature control device 40 is cooled by heat exchange with a coolant passing through the coolant flow path 43, the temperature control device 40 can be prevented from coming into a state being difficult to perform control due to excessive heating even when the application work is carried out for a long time on the stage 10 that is heated to high temperature. In addition, the coolant further acts to reduce the radiant heat from the heat shield member 42 by cooling the heat shield member 42 (namely, the above-mentioned first problem is solved).

Moreover, because the temperature of the liquid material in a liquid chamber 14 is adjusted to a level near a room temperature, the discharge amount can be measured by the weighing device outside the stage under the same conditions as those on the stage (namely, the above-mentioned second problem is solved), and the problem of shortening of the pot life does not occur (namely, the above-mentioned third problem is solved). Depending on uses, a heating medium for heating the temperature control device 40 may be supplied to flow through the heat-exchange flow path 43 in the present invention. A heat exchange fluid supplied to flow through the heat-exchange flow path 43 may be gas or a liquid on a case-by-case basis.

Embodiments of the present invention will be described below.

First Embodiment

Figure 2:
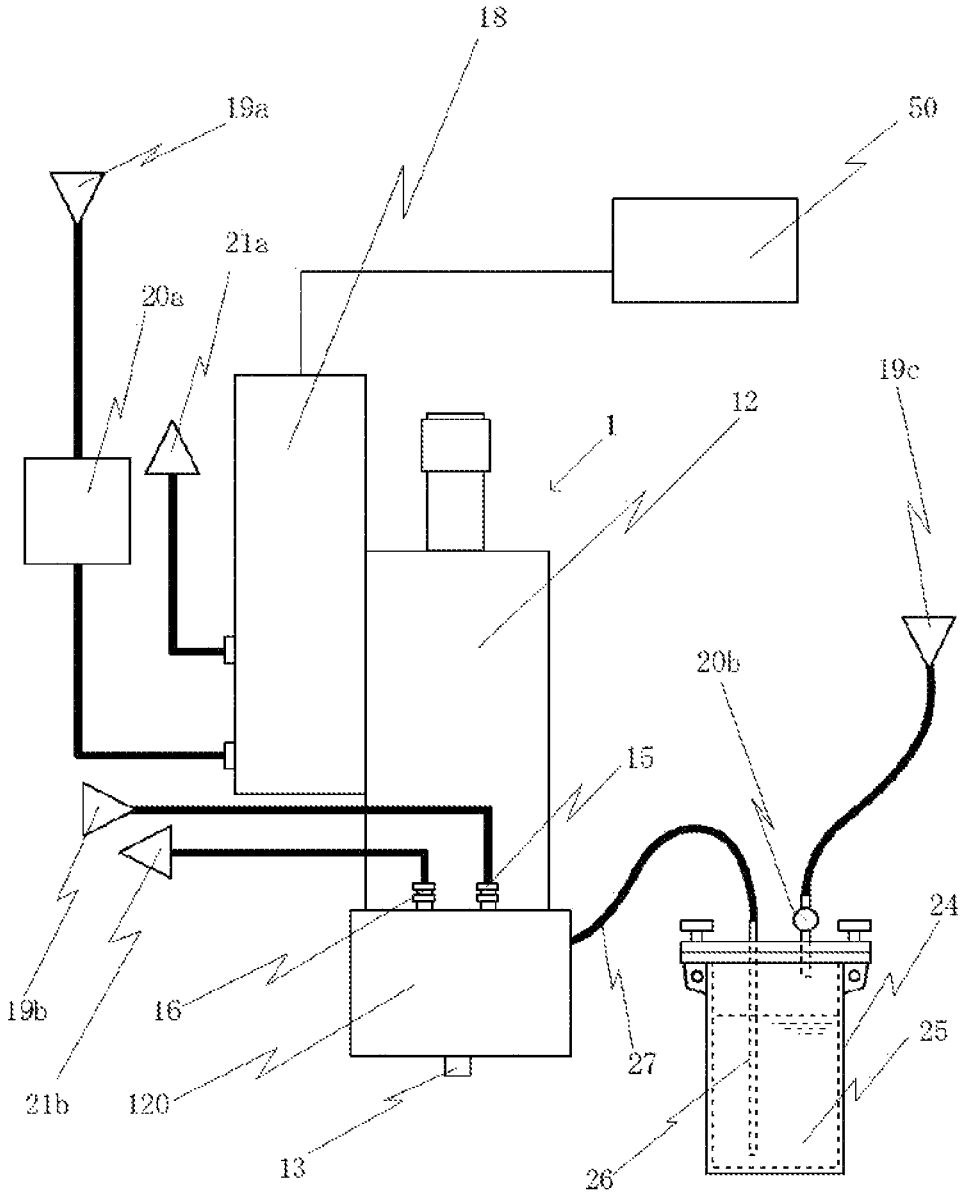
FIG. 2 is a front view of a discharge device according to a first embodiment.

The discharge device 1 according to the first embodiment of the present invention, illustrated in FIG. 2, includes a discharge device main body 12, a nozzle member 13, a switching valve 18, air supply sources 19*a* to 19*c*, a storage tank 24, the temperature control device unit 120, and a discharge control device 50.

The nozzle member 13 is a tubular member and has a discharge port opened downward. The nozzle member 13 is inserted into a lower end portion of the discharge device main body 12 and is in fluid communication with the liquid chamber 14.

Figure 3:
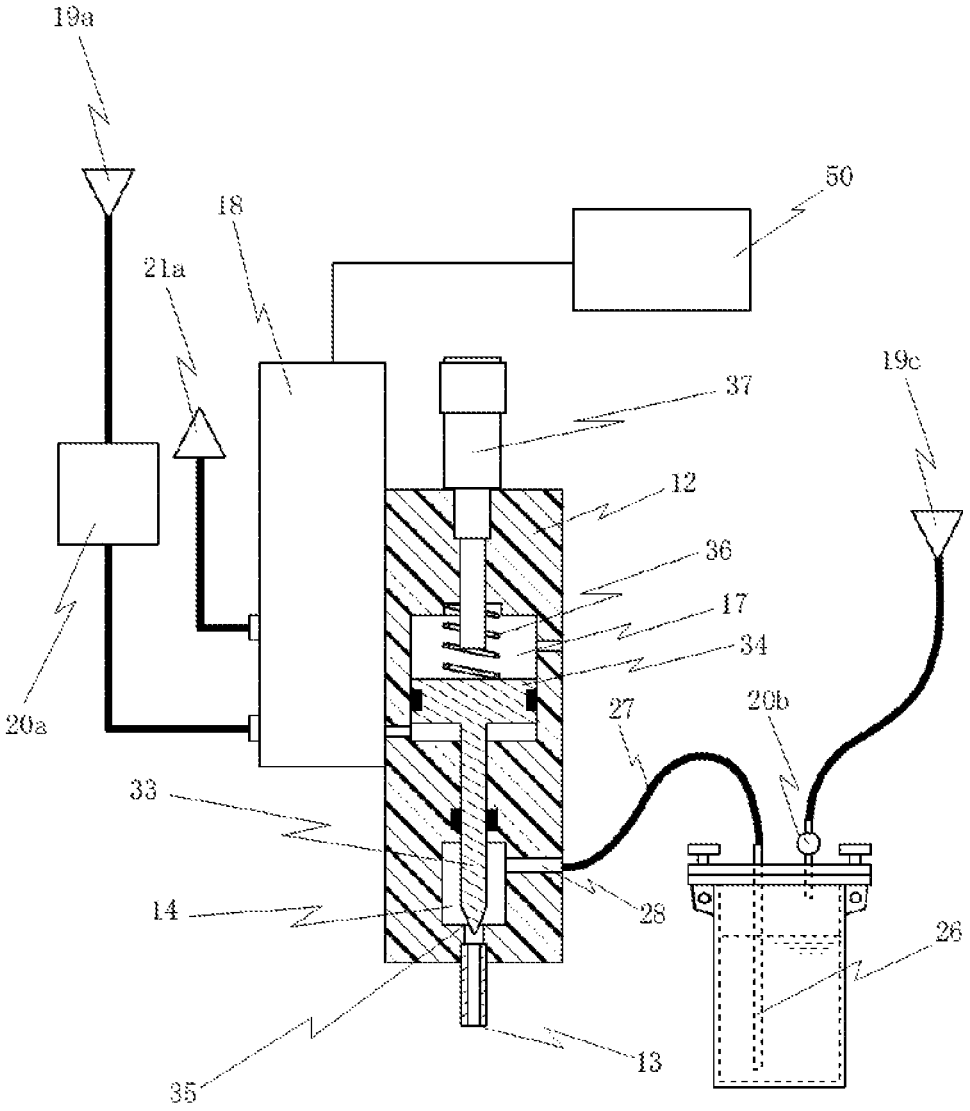
FIG. 3 is a partially sectional front view of the discharge device according to the first embodiment.

As illustrated in FIG. 3, a valve member 33 is inserted into the liquid chamber 14. When the valve member 33 departs away from a valve seat 35 formed in an inner bottom surface of the liquid chamber 14, the nozzle member 13 and the liquid chamber 14 are communicated with each other, thus allowing a liquid material to be discharged, and when the valve member 33 is seated against the valve seat 35, the communication between the nozzle member 13 and the liquid chamber 14 is cut and the discharge of the liquid material is stopped. A piston 34 air-tightly dividing a piston chamber 17 into two parts is disposed in a rear end portion (upper portion) of the valve member 33, and the piston 34 is biased downward by a spring 36. When the switching valve 18 takes a first position at which a lower space of the piston chamber 17 and the air supply source 19*a* are communicated with each other, pressurized air regulated to an appropriate pressure level by a pressure reducing valve 20*a* is supplied to the lower space of the piston chamber 17, and the piston 34 is moved upward. When the switching valve 18 takes a second position at which the lower space of the piston chamber 17 and an outlet port 21*a* are communicated with each other, the air in the lower space of the piston chamber 17 is expelled out and the piston 34 is moved downward by resilient force of the spring 36. At the first position, the liquid material is discharged because the discharge port and the liquid chamber 14 are communicated with each other. At the second position, the discharge of the liquid material is stopped because the communication between the discharge port and the liquid chamber 14 is cut.

The liquid chamber 14 formed in a lower portion of the discharge device main body 12 is in communication with a supply flow path 28 through an opening that is formed in an upper lateral surface of the liquid chamber 14. An opening of the supply flow path 28 on the opposite side to the liquid chamber 14 is in communication with a liquid feed tube 27, and the liquid material 25 in the storage tank 24 is supplied to the supply flow path 28 through the liquid feed tube 27 that is connected to a pipe 26. Pressurized air supplied from the air supply source 19*c* and regulated to an appropriate pressure level by a pressure reducing valve 20*b* is supplied to an upper space of the storage tank 24.

As illustrated in FIGS. 2 and 3, the liquid chamber 14 is surrounded by the temperature control device unit 120, and a temperature of the liquid material in the liquid chamber 14 is adjusted to a level optimum for the discharge (the temperature control device unit 120 is not illustrated in FIG. 3). The temperature control device unit 120 includes a heat source (not illustrated) and a temperature control jacket 41 both functioning as the heat-transfer temperature control device, and the heat shield member 42 and the coolant flow path 43 both functioning as the heat-shield temperature control device. With the provision of the temperature control device unit 120, even above the stage under heating, the temperature of the liquid material can be controlled to a level (e.g., 15 to 40° C.) near the room temperature or within a range of the room temperature ±10° C. It is to be noted that, at a position outside the stage under heating, the temperature of the liquid material can be controlled to be kept within the desired temperature range only by the heat-transfer temperature control device.

Figure 4:
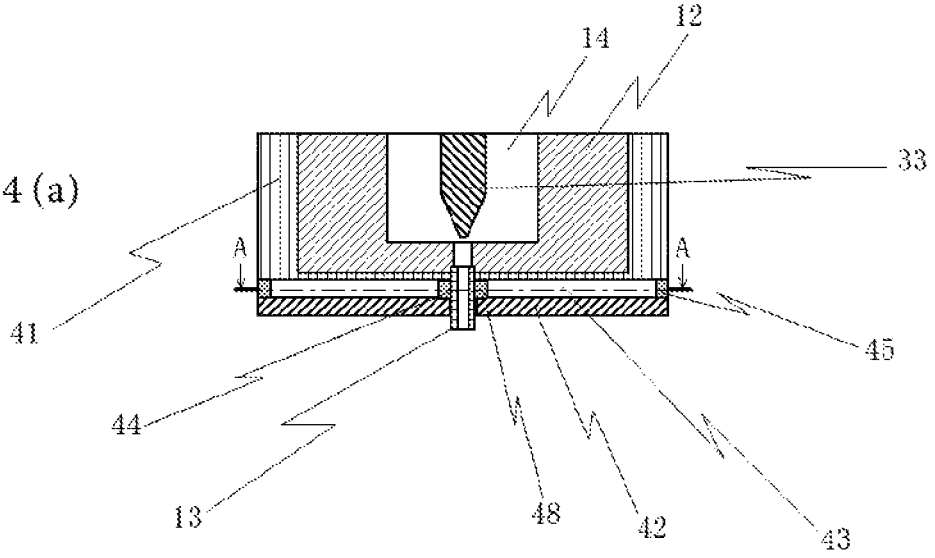
FIG. 4(*a*) is a partially sectional front view of a temperature control device unit according to the first embodiment, and FIG. 4(*b*) is a sectional view taken along A-A.
Figure 4:
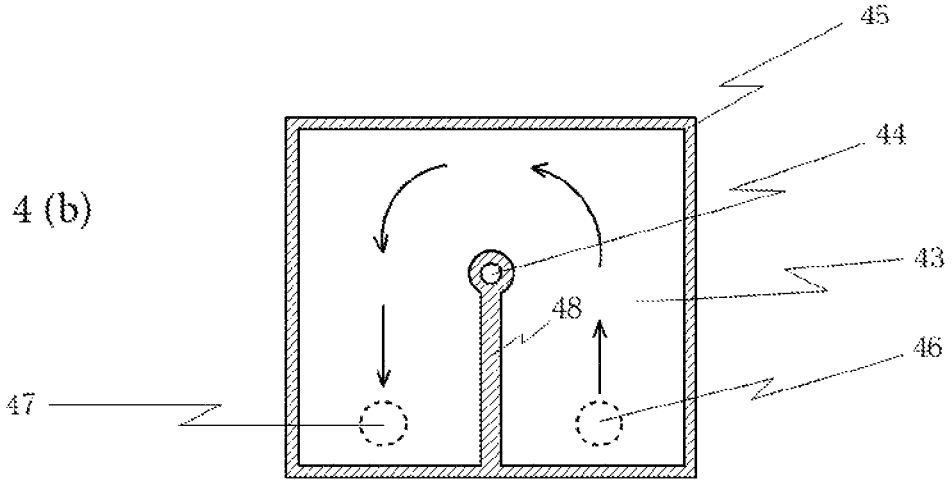

As illustrated in FIG. 4(*a*), the temperature control jacket 41 is a rectangular parallelepiped thermally-conductive member that covers a lateral surface and a bottom surface of a portion (lower end portion) of the discharge device main body 12 in which the liquid chamber 14 is formed, and that has a recess opened at a top. The temperature control jacket 41 is made of a material having a high thermal conductivity, such as metal, for transferring heat from a heat source (not illustrated), such as a heater or cold air, to the liquid chamber 14. The temperature control jacket 41 may have a structure in which there is no space between the heat source and itself, or a structure in which there is a space between the heat source and itself, the space allowing a heat-exchange fluid to pass therethrough. However, even when the temperature control jacket 41 is constituted in the structure having the space through which the heat-exchange fluid passes, the space is to be designed as an independent space with respect to the heat-exchange flow path (coolant flow path) 43 in the heat-shield temperature control device (namely, the heat-exchange fluid for the heat-transfer temperature control device and the heat-exchange fluid for the heat-shield temperature control device are to be not mixed with each other) from the viewpoint of avoiding, for example, the problem that control is complicated. The temperature control jacket may have any suitable shape different from that of the illustrated temperature control jacket 41. In an alternative example, the temperature control jacket may be constituted so as to cover only the bottom surface of the portion (lower end portion) of the discharge device main body 12 in which the liquid chamber 14 is formed, or to cover only the lateral surface of the portion (lower end portion) of the discharge device main body 12 in which the liquid chamber 14 is formed.

The heat shield member 42 is a rectangular plate-like member disposed under the temperature control jacket 41 with a gap kept therebetween. The heat shield member 42 is preferably made of a material (e.g., resin) having a low thermal conductivity. Lengths of a longitudinal side and a transverse side of the heat shield member 42 are equal to or longer than those of a longitudinal side and a transverse side of a bottom surface of the temperature control jacket 41. A positional relation between the heat shield member 42 and the temperature control jacket 41 is such that, when viewed from the bottom surface side, the temperature control jacket 41 cannot be seen because it is blocked by the heat shield member 42. The heat shield member 42 may have any desired shape without being limited to the illustrated one.

The bottom surface of the heat shield member 42 has the function as an electromagnetic-wave reflection surface that reflects an infrared ray (particularly a far-infrared ray of 4 to 1000 μm, also called a heat ray) radiated from the stage 10 and the workpiece 11. The bottom surface of the heat shield member 42 is constituted as a metal surface (made of, e.g., SUS (stainless steel) or a plating of silver or aluminum) that has high infrared reflection efficiency and includes no irregularities, or as a coating film surface that is formed by coating a paint reflecting the infrared ray and includes no irregularities. The bottom surface of the heat shield member 42 is preferably finished to a mirror surface. Although, in this embodiment, the heat shield member 42 has a size covering the entire bottom surface of the temperature control jacket 41, the heat shield member 42 may have a size covering a half or more (preferably ⅔ or more and more preferably ¾ or more) of the entire bottom surface of the temperature control jacket 41.

The coolant flow path 43 is a closed space sandwiched between the bottom surface of the temperature control jacket 41 and an upper surface of the heat shield member 42, and a wall 45 is disposed at a lateral surface of the coolant flow path 43. A partition wall 48 extends from one of four sides defining the wall 45 up to near a center, and a discharge hole 44, which is a through-hole, is formed in a tip of the partition wall 48. Projections or recesses may be formed on or in the bottom surface of the temperature control jacket 41 and surfaces of the wall 45 and/or the partition wall 48, the surfaces coming into contact with the coolant, to increase a surface area and hence to increase efficiency of the heat exchange. When the temperature control jacket 41 is constituted, unlike the illustrated form, so as to cover only the lateral surface of the portion (lower end portion) of the discharge device main body 12 in which the liquid chamber 14 is formed, the coolant flow path 43 is constituted by a closed space that is sandwiched between a bottom surface of the lower end portion of the discharge device main body 12 and the upper surface of the heat shield member 42.

FIG. 4(*b*) is a sectional view taken along A-A in FIG. 4(*a*). The coolant flow path 43 is in communication with a coolant supply port 46 and a coolant outlet port 47. The coolant supplied from the coolant supply port 46 passes through the coolant flow path 43 while performing heat exchange, and it is then expelled out from the coolant outlet port 47. With the provision of the partition wall 48, the coolant supplied from the coolant supply port 46 reaches the coolant outlet port 47 through a path denoted by arrows. The partition wall 48 prevents the coolant from reaching the coolant outlet port 47 through the shortest path, thereby increasing efficiency of the heat exchange.

Figure 5:
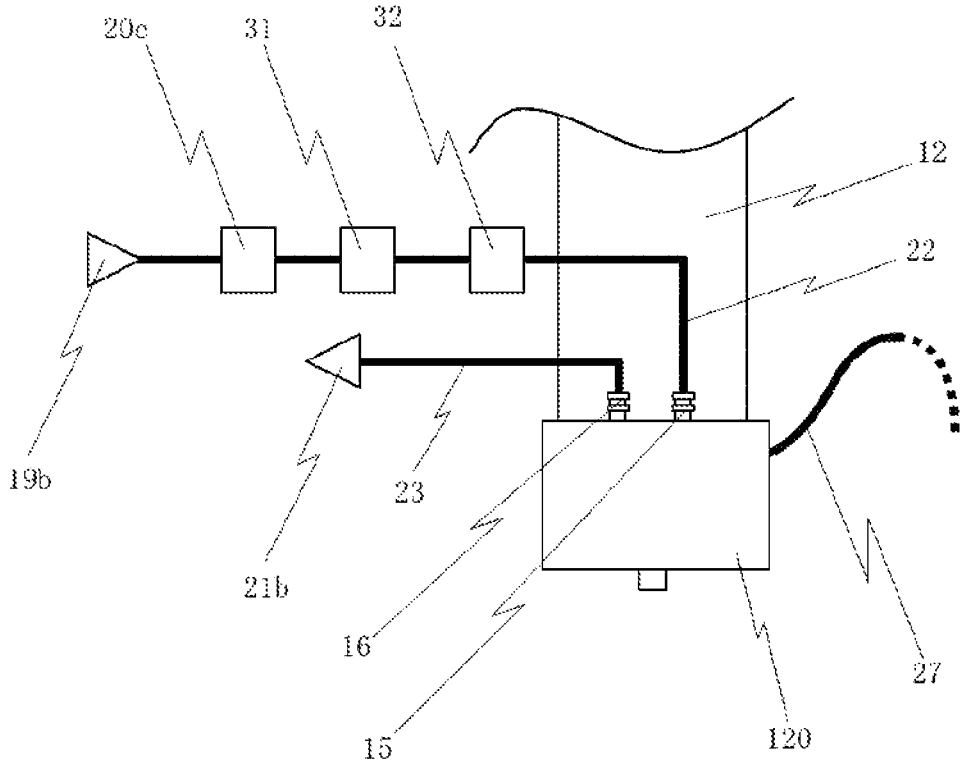
FIG. 5 is an enlarged front view of principal part of the discharge device according to the first embodiment.

FIG. 5 is an enlarged front view of principal part of the discharge device 1 according to the first embodiment. A supply joint 15 is coupled to the coolant supply port 46 of the temperature control device unit 120, and an outlet joint 16 is coupled to the coolant outlet port 47. A pressure reducing valve 20*c*, a flow control valve 31, and an on-off valve 32 are disposed (though not illustrated in FIG. 2) in a tubing line 22 that communicates the air supply source 19*b* and the supply joint 15 with each other. In the first embodiment, because it is desired to control the liquid chamber 14 to be held at the room temperature (e.g., 18 to 30° C.), the air supply source 19*b* for pressurizing and supplying outside air is utilized as a coolant delivery device (heat-exchange fluid delivery device). The pressurized air supplied from the air supply source 19*b* is regulated to an appropriate pressure level by the pressure reducing valve 20*c*, is adjusted to a desired flow rate by the flow control valve 31, and is supplied to the coolant flow path 43 through the on-off valve 32. Thus, the pressurized air functions as the coolant. It is to be noted that, in the first embodiment, the on-off valve 32 is always kept in an on-state during the work using the discharge device 1.

Each of the air supply sources 19*a* to 19*c* is constituted by a compressor or a cylinder installed in a factory, for example, and is connected to a tubing line, which is in communication with a supply destination, through a removable connector (not illustrated).

The outlet joint 16 is in communication with an outlet port 21*b* through a tubing line 23. The pressurized air having passed through the coolant flow path 43 is expelled out from the outlet port 21*b* through the outlet joint 16 and the tubing line 23.

Figure 6:
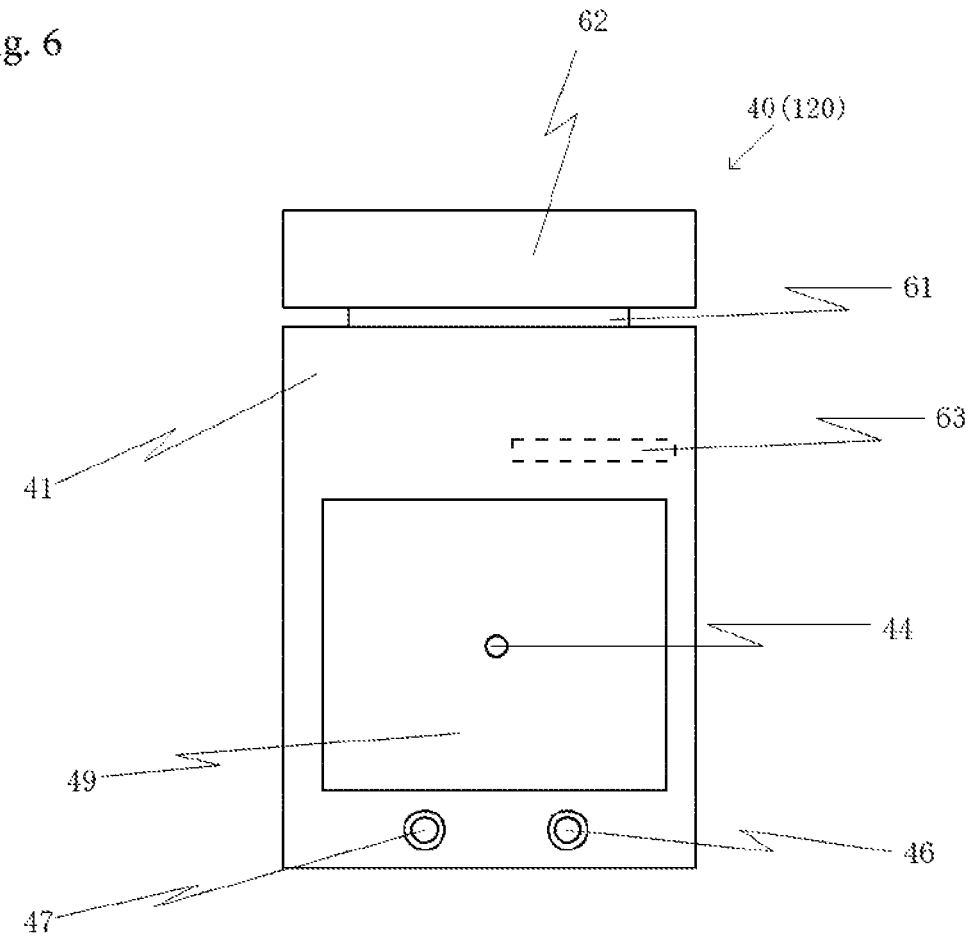
FIG. 6 is a horizontal sectional view of the temperature control device unit according to the first embodiment.

FIG. 6 is a horizontal sectional view of the temperature control device unit 120 according to the first embodiment. The temperature control jacket 41 includes a discharge-portion insertion opening 49 through which the lower end portion of the discharge device main body 12 is inserted. An inner wall surface of the discharge-portion insertion opening 49, which is brought into contact with the discharge device main body 12, is preferably made of a material (e.g., metal) having a high thermal conductivity. More preferably, the entirety of the temperature control jacket 41 is made of the material (e.g., metal) having the high thermal conductivity.

The discharge hole 44, which is a through-hole, is formed at a center of the discharge-portion insertion opening 49, and the nozzle member 13 is inserted through the discharge hole 44. The coolant supply port 46 and the coolant outlet port 47 are disposed near one of four sides defining the discharge-portion insertion opening 49, and a temperature sensor 63 is disposed near another side. A fin-shaped heatsink 62 is disposed along a lateral surface of the temperature control jacket 41 with a Peltier element 61 interposed therebetween, thus dissipating heat of the temperature control jacket 41 to the outside. In other words, in this embodiment, the temperature control device 40 is constituted by a heat source, which is made up of the Peltier element 61 and the heatsink 62, and by the temperature control jacket 41. An electric fan may be disposed in association with the heatsink 62 though not disposed in this embodiment.

The temperature sensor 63 is a thermocouple or a resistance thermometer, for example. The temperature of the temperature control jacket 41, which is measured by the temperature sensor 63, is sent to the discharge control device 50.

The discharge control device 50 is a computer for controlling operations of the switching valve 18, the flow control valve 31, and the on-off valve 32. The discharge control device 50 has the function of performing control independently of the heat-transfer temperature control device 40 and the heat-shield temperature control device (42, 43). The discharge control device 50 executes temperature control in such a manner that when the temperature of the temperature control jacket 41 is determined to be high on the basis of a signal from temperature sensor 63, the discharge control device 50 controls the flow control valve 31 to increase the flow rate of the coolant, and that when the temperature of the temperature control jacket 41 is determined to be within an allowable range, the discharge control device 50 controls the flow control valve 31 to reduce the flow rate of the coolant. A control method is not limited to particular one. For example, PID (Proportional-Integral-Differential) control, feedback control, or on-off control is used. The number and positions of temperature sensors 63 to be arranged are not limited to the illustrated ones, and the temperature sensor 63 may be disposed, for example, in or near the coolant flow path. Alternatively, the coolant may be supplied in a constant flow rate at all times or in a varying flow rate without disposing the temperature sensor 63.

<Application Device>

Figure 7:
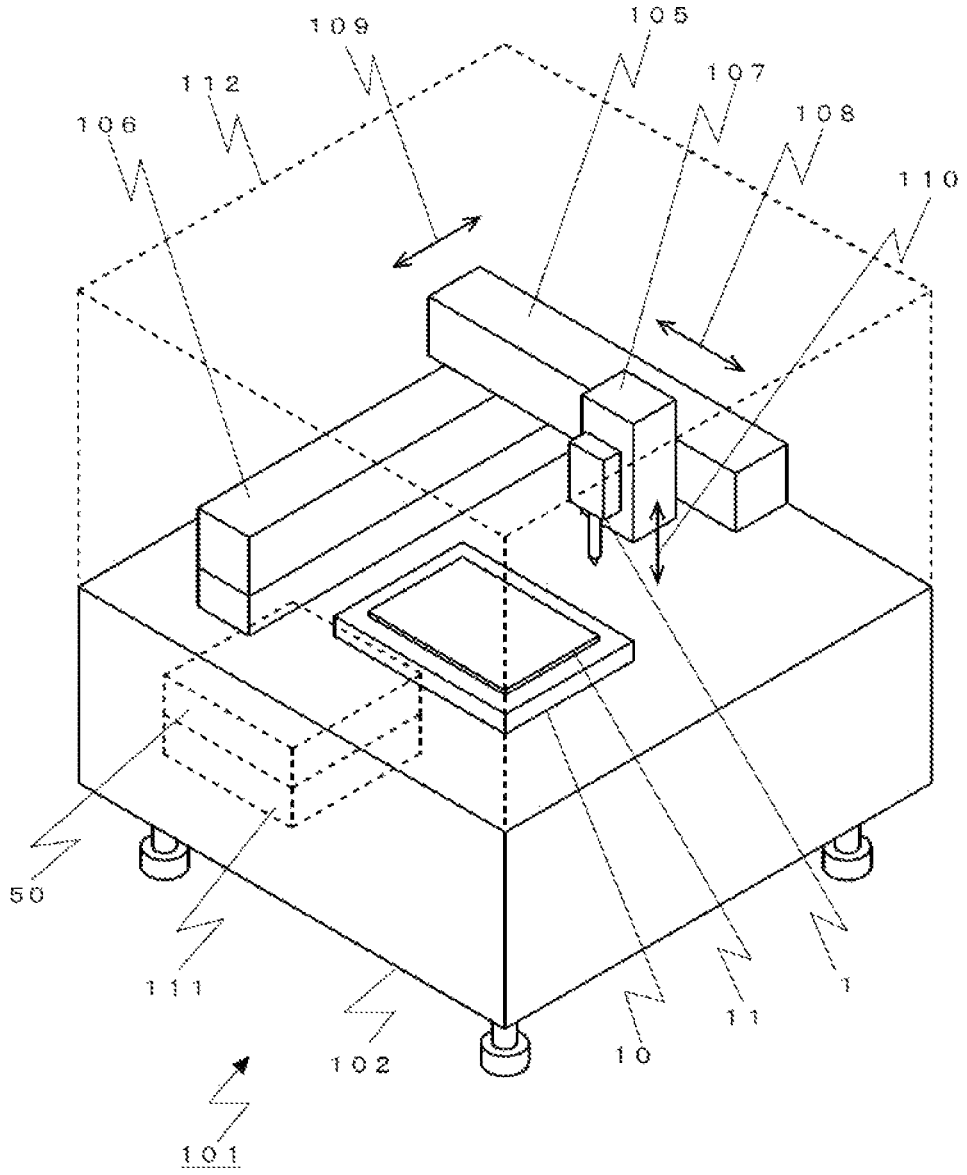
FIG. 7 is a schematic perspective view of an application device according to the first embodiment.

FIG. 7 is a schematic perspective view of an application device 101 equipped with the discharge device 1 according to the first embodiment.

The application device 101 according to the first embodiment includes, on a bench 102, the stage 10 on which the workpiece 11, i.e., an application target is placed, a heater (not illustrated) for heating the stage 10, and a set of an X drive device 105, a Y drive device 106, and a Z drive device 107 for moving the discharge device 1 relative to the workpiece 11.

The XYZ drive devices (105, 106, 107) are relative moving devices that move the discharge device 1 and the stage 10 relative to each other in directions denoted by signs 108, 109 and 110, respectively. The discharge control device 50 for controlling the operations of the above-described discharge device 1, a drive control device 111 for controlling the operations of the above-described drive devices (105, 106, 107), and the heater (not illustrated) are installed inside bench 102. For example, a heater disclosed in Patent Document 2 can be used as the heater.

The heater is capable of heating the stage 10 to temperature higher than the room temperature by 20° C. to 80° C. or 30° C. to 70° C., for example.

A space above the bench 102 is covered with a cover 112 denoted by dotted lines, and the space can be brought into a negative pressure environment by using a not-illustrated vacuum pump, for example. The cover 112 may be provided with a door for access to the inside.

With the above-described discharge device 1 according to the first embodiment, even when discharge work is carried out on workpieces placed at places where temperatures are much different from one another (e.g., on workpieces subjected to the temperature difference of 20° C. to 80° C. or 30° C. to 70° C.), the discharge work can be carried out without causing variations in discharge amount. Furthermore, since the liquid material 25 is not needed to be heated more than necessary, the pot life of the liquid material can be prolonged.

Second Embodiment

Figure 8:
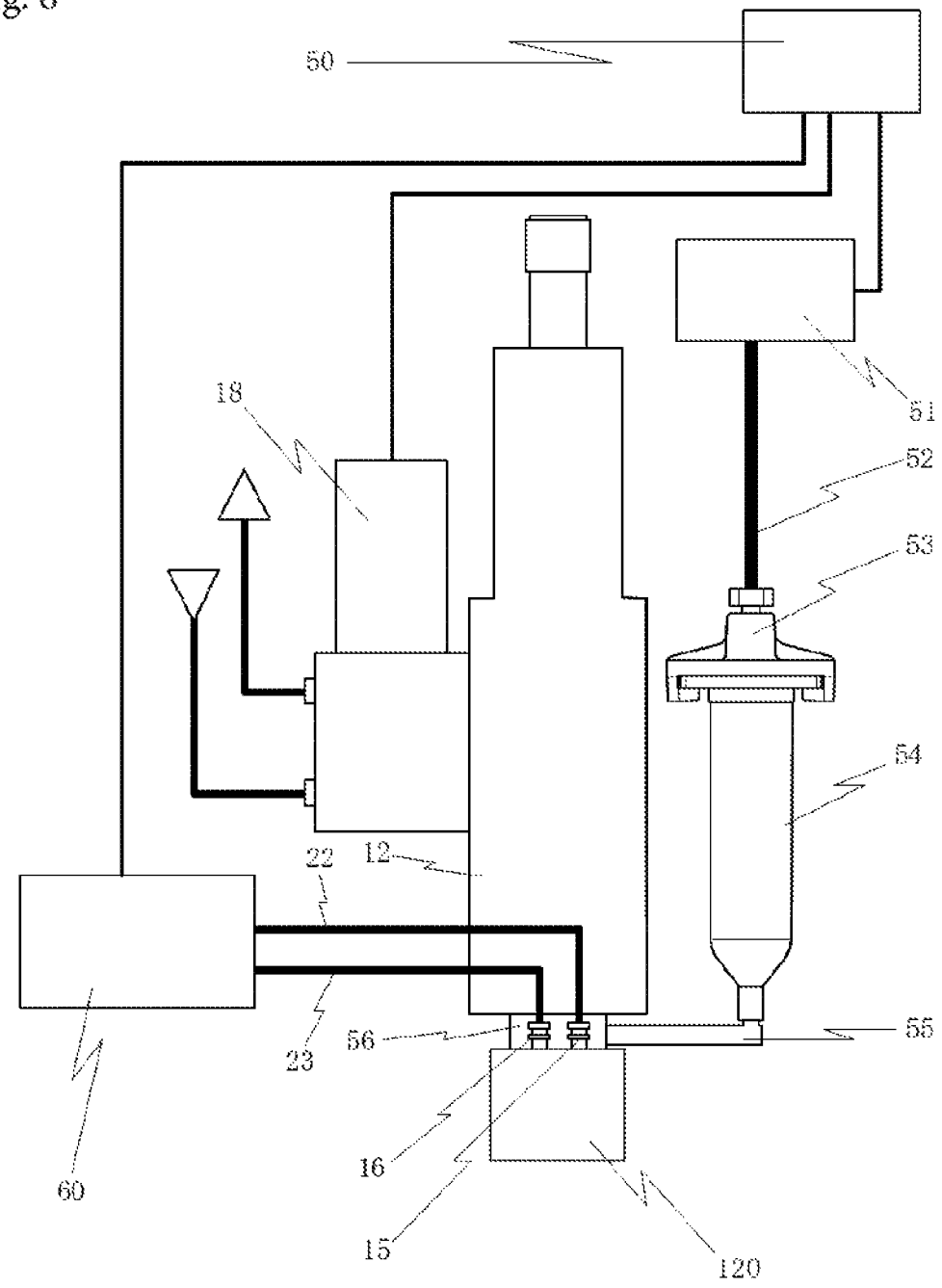
FIG. 8 is a front view of a discharge device according to a second embodiment.

A liquid material discharge device 1 according to a second embodiment, illustrated in FIG. 8, is different from that according to the first embodiment mainly in including a discharge member 56 and a circulation pump 60. In the following, different points from the first embodiment are mainly described, and description of elements common to the first embodiment is omitted.

The discharge member 56 is a block-like member constituting the lower end portion of the discharge device main body 12 and is made of a material (e.g., metal) having a high thermal conductivity. The discharge member 56 may be removably or integrally attached to another portion of the discharge device main body 12 (e.g., an upper portion than the illustrated discharge member 56). The liquid chamber 14 is formed inside the discharge member 56, and a tip portion of the valve member 33, which is narrower than the liquid chamber, is inserted into the liquid chamber 14 (see FIG. 9). A lateral peripheral surface of the valve member 33 does not contact with an inner surface of the liquid chamber 14, and friction generated during movement of the valve member 33 is minimized. Therefore, the valve member 33 can be moved at a high speed.

A cap-like nozzle member 57 is mounted to an opening formed in a lower end portion of the discharge member 56, and an inner space of the nozzle member 57 also constitutes the liquid chamber 14. A through-hole constituting a discharge port 58 (see FIG. 10) is formed at a center of a bottom portion of the nozzle member 57, and an inner bottom surface of the nozzle member 57 near the through-hole constitutes a valve seat. The discharge device 1 according to the second embodiment is a jet discharge device of seating type in which the liquid material is discharged in a droplet state from the discharge port 58 by causing a tip of the valve member 33 moving forward at a high speed to be seated against the valve seat. The discharge device 1 may be a jet discharge device of non-seating type in which the valve member 33 is abruptly stopped near the valve seat without causing the valve member 33 to be seated against the valve seat.

Figure 10:
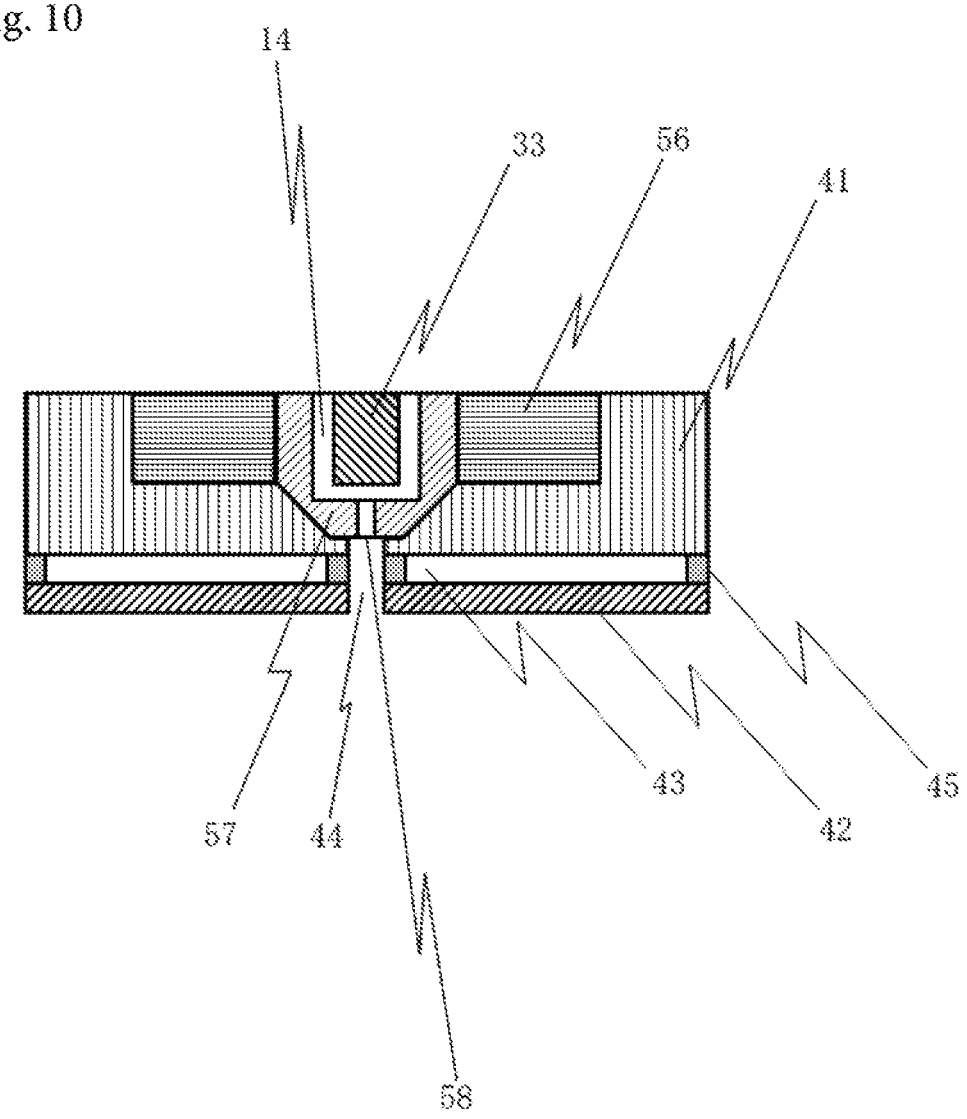
FIG. 10 is a partially sectional front view of a temperature control device unit according to the second embodiment.

A lower half portion of the discharge member 56 and the nozzle member 57 are surrounded by the temperature control jacket 41. As in the first embodiment, the temperature control jacket 41 transfers heat from a heat source to the liquid chamber 14. As illustrated in FIG. 10, the heat shield member 42 is disposed under the temperature control jacket 41 with a gap interposed therebetween, the gap forming the coolant flow path 43. The heat shield member 42, the coolant flow path 43, and the wall 45 have similar structures to those in the first embodiment. The discharge hole 44 is in communication with the discharge port 58, and the liquid material discharged from the discharge port 58 is discharged to the outside from a lower end opening of the discharge hole 44.

The temperature control device unit 120 is in fluid communication with the circulation pump 60 (heat-exchange fluid delivery device) through the supply joint 15 and the outlet joint 16. A circulation path through which the coolant is supplied to the coolant flow path 43 is formed by connecting the supply joint 15 and the circulation pump 60 to establish fluid communication through the tubing line 22, and by connecting the outlet joint 16 and the circulation pump 60 to establish fluid communication through the tubing line 23.

The opening in communication with the supply flow path 28 is formed in the upper lateral surface of the liquid chamber 14. A liquid feed path having one end in communication with the supply flow path 28 and the other end in communication with a storage container 54 is formed in a liquid feed member 55. The storage container 54 is formed of a commercially available syringe, and an adapter 53 is fitted to an upper opening of the storage container 54. The adapter 53 is connected to a pressure feed tube 52 through which pressurized air is supplied to the storage container 54. The pressure feed tube 52 is in communication with an air supply port of an air dispenser 51 for supplying the pressurized air that is regulated to an appropriate pressure level in accordance with a setting value.

The discharge control device 50 is connected to the air dispenser 51, the switching valve 18, and the circulation pump 60 via cables, and it controls operations of those components.

The circulation pump 60 delivers the cooled coolant from a delivery port through the tubing line 22, and recovers the coolant, which has been heated with the heat exchange, from a recovery port through the tubing line 23. For example, a displacement pump, such as a diaphragm pump or a plunger pump, may be used as the circulation pump 60. The circulation pump 60 includes a cooling device (not illustrated) and delivers again, from the delivery port, the coolant after cooling the heated coolant by the cooling device. The coolant delivered from the circulation pump 60 is a fluid, and it may be a gas coolant such as $CO_2$, or a liquid coolant such as water.

The above-described discharge device 1 according to the second embodiment can also provide similar advantageous effects to those obtained in the first embodiment.

In addition, with the discharge device 1 according to the second embodiment, the liquid material in the liquid chamber 14 can be controlled to temperature higher or lower than the room temperature.

Third to Fifth Embodiments

Figure 11:
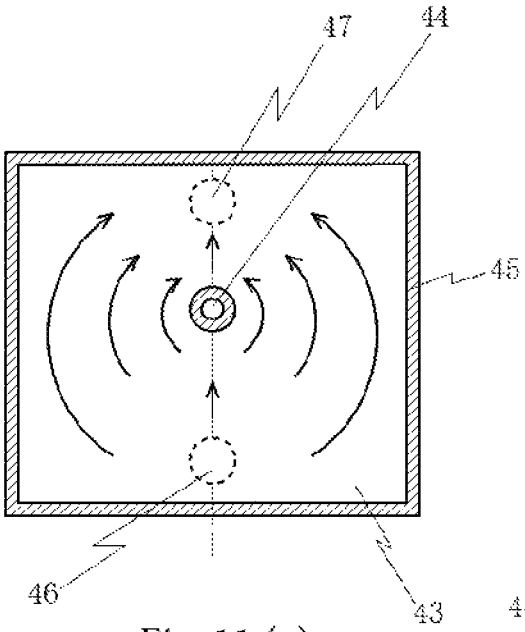
FIG. 11(*a*) is a horizontal sectional view illustrating a structure of a coolant flow path in a third embodiment, FIG. 11(*b*) is a horizontal sectional view illustrating a structure of the coolant flow path in a fourth embodiment, and FIG. 11(*c*) is a horizontal sectional view illustrating a structure of the coolant flow path 43 in a fifth embodiment.
Figure 11:
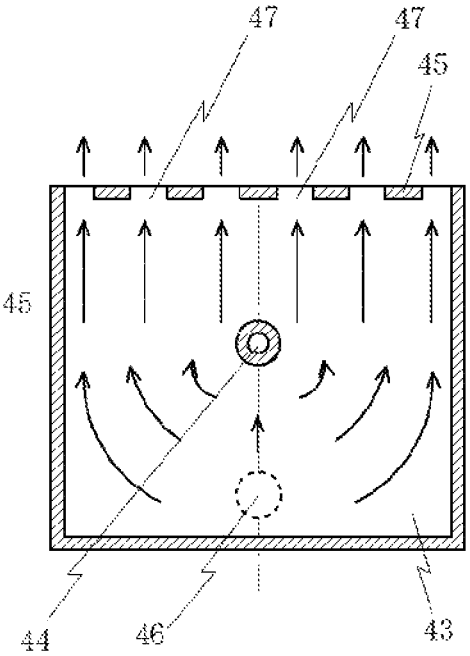
Figure 11:
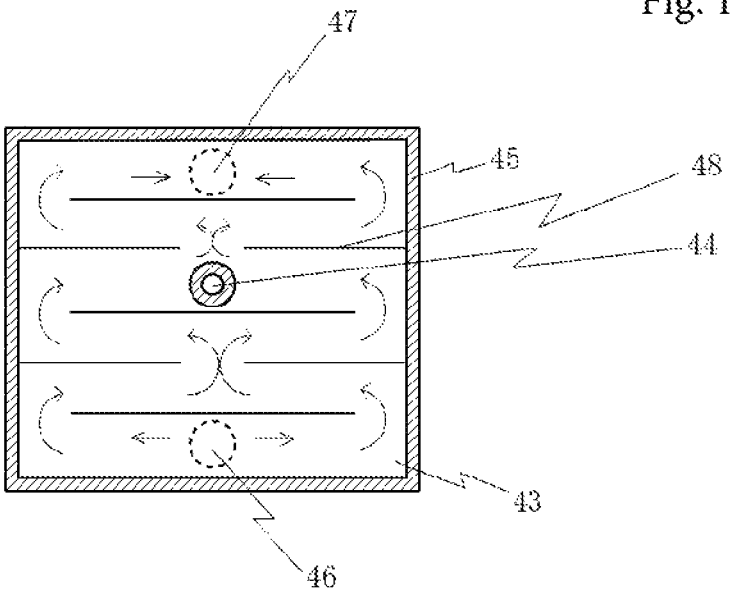

Liquid material discharge devices 1 according to third to fifth embodiments, illustrated in FIG. 11, are different from that according to the first embodiment only in structure of the coolant flow path 43. In the following, only different points from the first embodiment are described, and description of elements common to the first embodiment is omitted.

FIG. 11(*a*) is a horizontal sectional view illustrating a structure of the coolant flow path 43 in the third embodiment, FIG. 11(*b*) is a horizontal sectional view illustrating a structure of the coolant flow path 43 in the fourth embodiment, and FIG. 11(*c*) is a horizontal sectional view illustrating a structure of the coolant flow path 43 in the fifth embodiment.

The coolant flow path 43 in the third embodiment receives the coolant from the coolant supply port 46 positioned in a top surface of the coolant flow path 43 near one side of the wall 45, and causes the coolant to be expelled out from the coolant outlet port 47 positioned in the top surface of the coolant flow path 43 near another one side of the wall 45 which is farthest away from the coolant supply port 46. The discharge hole 44 is formed in a center portion of the coolant flow path 43. The coolant flows substantially as denoted by arrows in the drawing.

The coolant flow path 43 in the fourth embodiment receives the coolant from the coolant supply port 46 positioned in the top surface of the coolant flow path 43 near one side of the wall 45, and causes the coolant to be expelled out from the plurality of coolant outlet ports 47 formed in the wall 45 farthest away from the coolant supply port 46. The discharge hole 44 is formed in a center portion of the coolant flow path 43. The coolant flows substantially as denoted by arrows in the drawing.

The coolant flow path 43 in the fifth embodiment receives the coolant from the coolant supply port 46 positioned in the top surface of the coolant flow path 43 near one side of the wall 45, and causes the coolant to be expelled out from the coolant outlet port 47 positioned in the top surface of the coolant flow path 43 near another one side of the wall 45 which is farthest away from the coolant supply port 46. Seven partition walls 48 are disposed between the coolant supply port 46 and the coolant outlet port 47 such that the coolant reaches the coolant outlet port 47 through a long path. Projections or recesses may be formed on or in surfaces of the wall 45 and/or the partition walls 48 to increase a surface area coming into contact with the coolant. The discharge hole 44 is formed in a center portion of the coolant flow path 43. The coolant flows substantially as denoted by arrows in the drawing. The number and layout of the partition walls 48 are not limited to the illustrated ones.

The above-described discharge devices 1 according to the third to fifth embodiments can also provide similar advantageous effects to those obtained in the first embodiment.

Sixth Embodiment

Figure 9:
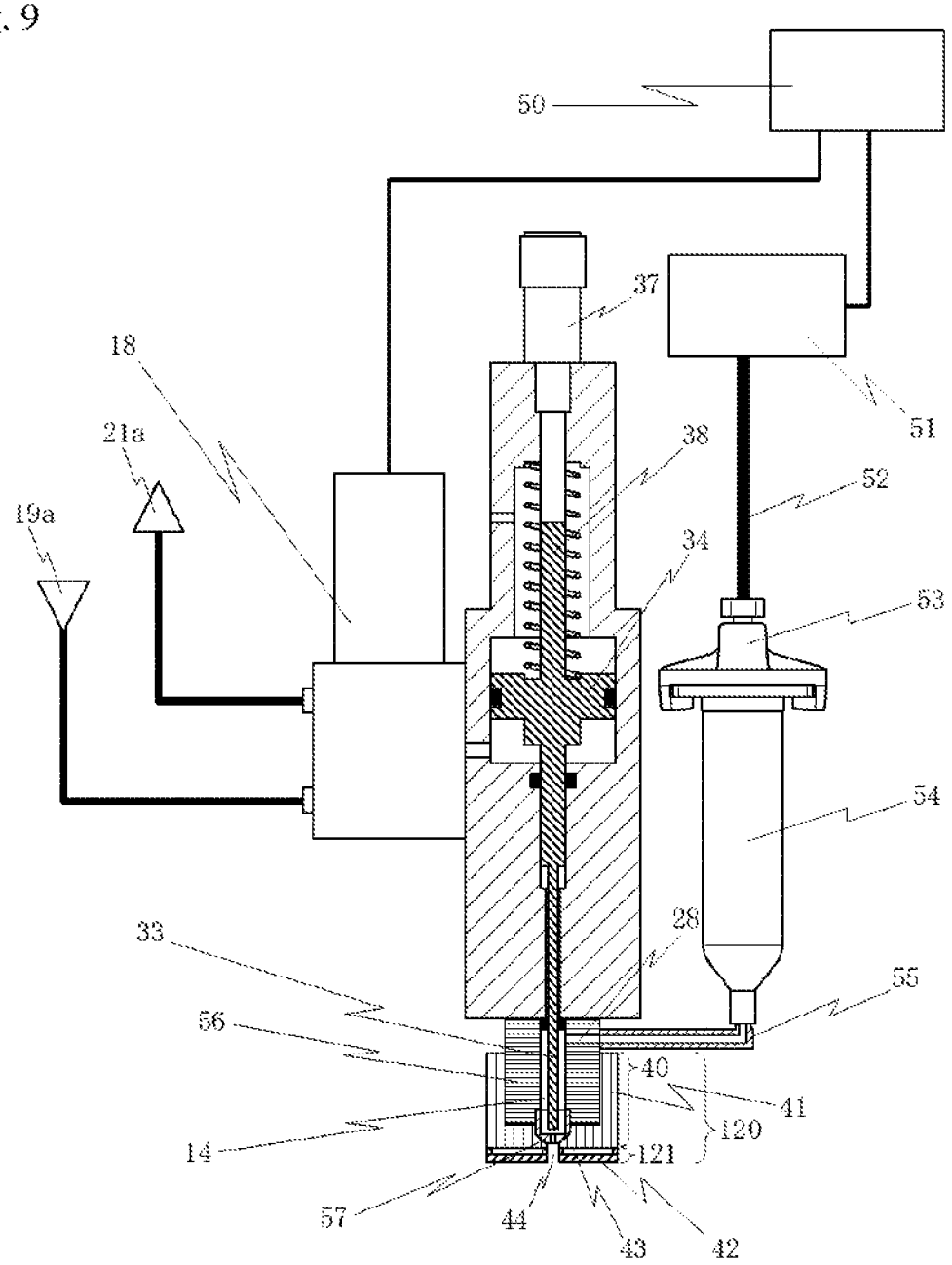
FIG. 9 is a partially sectional front view of the discharge device according to the second embodiment.

A liquid material discharge device 1 according to a sixth embodiment has a similar structure to that according to the second embodiment, illustrated in FIGS. 8 and 9, except for the coolant flow path and the heat shield member, but it is different mainly in including a heat shield member 70 equipped with coolant flow paths 73 and 74 in two layers. In the following, only different points from the second embodiment are described, and description of elements common to the second embodiment is omitted.

As illustrated in FIG. 12(*a*), the temperature control jacket 41 in the sixth embodiment includes, as in the first and second embodiments, the discharge-portion insertion opening 49, the coolant supply port 46, and the coolant outlet port 47, the ports 46 and 47 being disposed side by side near one of sides defining the discharge-portion insertion opening 49. The heatsink 62 is disposed along the lateral surface of the temperature control jacket 41 with the Peltier element 61 interposed therebetween, thus dissipating heat of the temperature control jacket 41 to the outside.

FIG. 12(*b*) is a sectional view taken along B-B in FIG. 12(*a*). In the liquid material discharge device 1 according to the sixth embodiment, a lower plate 71 and an upper plate 72 are disposed under the temperature control jacket 41. A lower coolant flow path 73 is formed between the lower plate 71 and the upper plate 72, and an upper coolant flow path 74 is formed between the upper plate 72 and the bottom surface of the temperature control jacket 41.

The lower plate 71 is the same as the heat shield member 42 in the second embodiment.

The upper plate 72 is a rectangular plate-like member made of a material (e.g., resin) having a low thermal conductivity, and it has the function as an electromagnetic-wave reflection surface that reflects an infrared ray (particularly a heat ray) from the lower plate 71 having been heated. At least a bottom surface of the upper plate 72 is constituted as a metal surface (made of, e.g., SUS (stainless steel) or a plating of silver or aluminum) that has high infrared reflection efficiency and includes no irregularities, or as a coating film surface that is formed by coating a paint reflecting the infrared ray and includes no irregularities. The bottom surface of the upper plate 72 is preferably finished to a mirror surface.

Because an amount of infrared radiation from the lower plate 71 is smaller than that from the stage 10 and the workpiece 11, a sufficient effect can be obtained even with the upper plate 72 having a smaller thickness than the lower plate 71.

The discharge hole 44 is formed so as to penetrate through the lower plate 71 and the upper plate 72, and the liquid material discharged from the discharge port 58 is discharged to the outside from the lower end opening of the discharge hole 44.

FIG. 12(*c*) is a sectional view taken along C-C in FIG. 12(*b*), and FIG. 12(*d*) is a sectional view taken along D-D in FIG. 12(*b*). The coolant supplied from the coolant supply port 46 is supplied to the lower coolant flow path 73 through a communication tube 64. Because a partition wall 48*a* is disposed in the lower coolant flow path 73, the coolant reaches a communication tube 65 through a path denoted by arrows in the drawing. After reaching the communication tube 65, the coolant passes through the upper plate 72 and reaches the upper coolant flow path 74. Because a partition wall 48*b* is disposed in the upper coolant flow path 74, the coolant reaches the coolant outlet port 47 through a path denoted by arrows in the drawing. Unlike the above case, the coolant may be supplied to flow in a direction toward the lower coolant flow path 73 from the upper coolant flow path 74. Projections or recesses may be formed on or in the bottom surface of the temperature control jacket 41, and surfaces of walls 45*a* and 45*b* and/or the partition walls 48*a* and 48*b* to increase a surface area coming into contact with the coolant.

With the above-described discharge device 1 according to the sixth embodiment, since the heat shield member 70 including the coolant flow paths 73 and 74 constituted in two layers is disposed under the temperature control jacket 41, the radiant heat from the stage 10 and the workpiece 11 can be prevented more effectively. Although, in this embodiment, the lower plate 71 and the upper plate 72 have a size covering the entire bottom surface of the temperature control jacket 41, they may have a size covering a half or more (preferably ⅔ or more and more preferably ¾ or more) of the entire bottom surface of the temperature control jacket 41.

Seventh Embodiment

Figure 13:
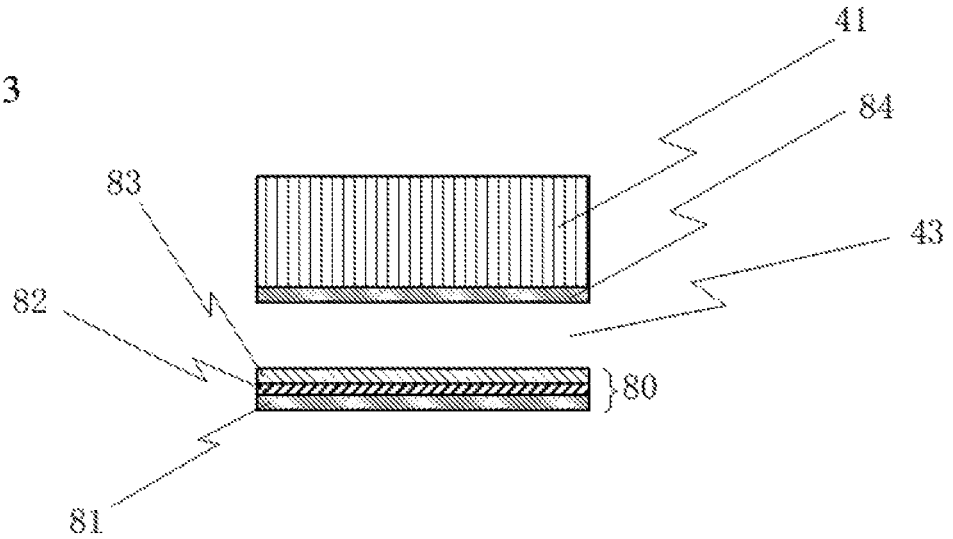
FIG. 13 is a partially sectional front view of a temperature control device unit according to a seventh embodiment.

A liquid material discharge device 1 according to a seventh embodiment, illustrated in FIG. 13, is different from that according to the first embodiment in including a heat shield member 80 of a three-layer structure and an infrared reflection layer 84. In the following, only different points from the first embodiment are described, and description of elements common to the first embodiment is omitted.

The heat shield member 70 in the seventh embodiment includes an infrared reflection layer 81 constituting a lowermost layer, a heat insulating layer 82 constituting an intermediate layer, and a heat transfer layer 83 constituting an uppermost layer.

The infrared reflection layer 81 is an electromagnetic-wave reflection surface that reflects an infrared ray (particularly a heat ray) from the stage 10 and the workpiece 11, and is constituted as a metal surface (made of, e.g., SUS (stainless steel) or a plating of silver or aluminum) that has high infrared reflection efficiency and includes no irregularities, or as a coating film surface that is formed by coating a paint reflecting the infrared ray and includes no irregularities. A bottom surface of the infrared reflection layer 81 is preferably finished to a mirror surface.

The heat insulating layer 82 is made of a material (e.g., resin) having a low thermal conductivity and it prevents the temperature control jacket 41 from being heated by radiant heat from an upper surface of the heat shield member 70 having been heated. The heat insulating layer 82 is preferably made of a material having a lower thermal conductivity than the infrared reflection layer 81 that corresponds to the bottom surface of the heat shield member 80.

The heat transfer layer 83 is made of a material (e.g., steel, aluminum, or silver) having a higher thermal conductivity than the infrared reflection layer 84. In other words, a material having a relatively high thermal conductivity is selected as the heat transfer layer 83 in order to preferentially cool the heat transfer layer 83 in comparison with the infrared reflection layer 84.

The infrared reflection layer 84 formed at the bottom surface of the temperature control jacket 41 is an electromagnetic-wave reflection surface that reflects not only an infrared ray (particularly a heat ray), i.e., radiant heat, from the stage 10 and the workpiece 11, but also an infrared ray (particularly a heat ray), i.e., radiant heat, from the upper surface of the heat shield member 80 having been heated, and is constituted as a metal surface (made of, e.g., SUS (stainless steel) or a plating of silver or aluminum) that has high infrared reflection efficiency and includes no irregularities, or as a coating film surface that is formed by coating a paint reflecting the infrared ray and includes no irregularities. A bottom surface of the infrared reflection layer 84 is preferably finished to a mirror surface.

When a high heat-shield effect is not required, the infrared reflection layer 84 does not need to be disposed at the bottom surface of the temperature control jacket 41. In such a case, the heat transfer layer 83 is preferably made of a material having a higher thermal conductivity than the bottom surface of the temperature control jacket 41.

With the above-described discharge device 1 according to the seventh embodiment, since the radiant heat from the stage 10 and the workpiece 11 are prevented while the heat shield member 80 is preferentially cooled, the application work on the stage 10 under heating can be performed for a longer time.

The heat shield member 70 of the three-layer structure and/or the infrared reflection layer 84 in this embodiment may be applied to the first to sixth embodiments as well.

Unlike this embodiment, the heat shield member 80 may be constituted by two layers, i.e., the infrared reflection layer 81 and the heat transfer layer 83, without disposing the heat insulating layer 82.

Eighth Embodiment

Figure 14:
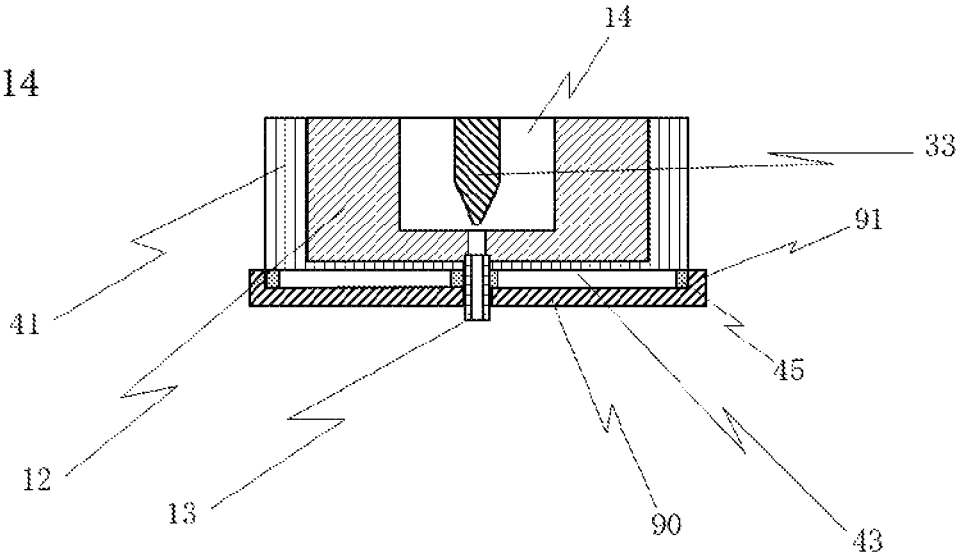
FIG. 14 is a partially sectional front view of a temperature control device unit according to an eighth embodiment.
Figure 15:
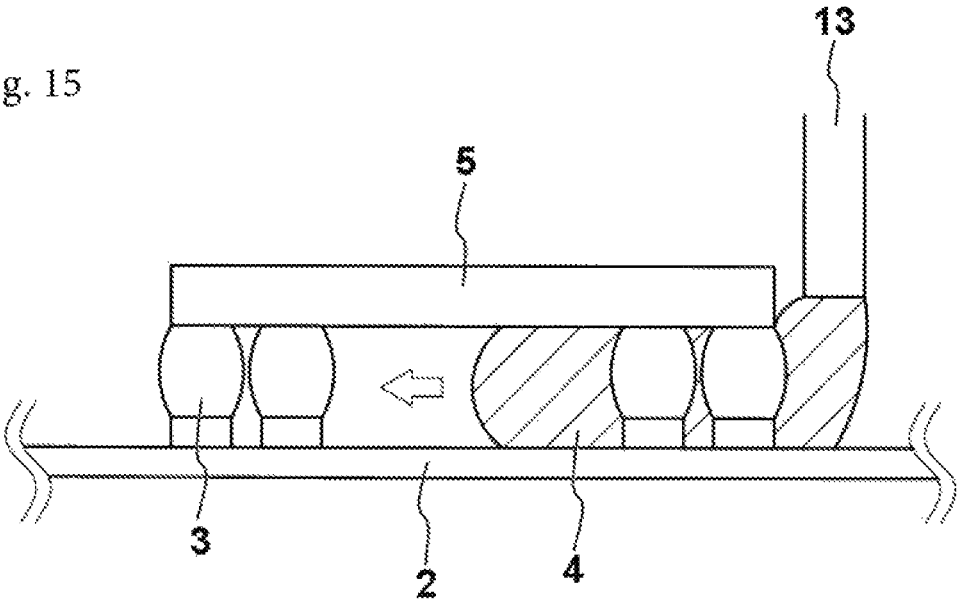
FIG. 15 is an explanatory view referenced to explain an underfill step.

A liquid material discharge device 1 according to an eighth embodiment, illustrated in FIG. 14, is different from that according to the first embodiment in including a heat shield member 90 having a larger area than the temperature control jacket 41. In the following, only different points from the first embodiment are described, and description of elements common to the first embodiment is omitted.

The heat shield member 90 in the eighth embodiment includes a rising portion 91 covering an outer lateral surface of the wall 45. A bottom surface and an outer lateral surface of the heat shield member 90 have the function as electromagnetic-wave reflection surfaces, and they are each constituted as a metal surface or a coating film surface, which reflects the infrared ray and includes no irregularities, as in the first embodiment.

Since a bottom surface of the heat shield member 90 in the eighth embodiment is formed in a size slightly larger than that of the temperature control jacket 41, the effect of preventing the radiant heat from the stage 10 and the workpiece 11 from reaching the lateral surface of the temperature control jacket 41 is increased.

The upper plate 72 in the sixth embodiment and/or the heat shield member 80 of the three-layer structure in the seventh embodiment may be combined with the larger-area heat shield member 90 in this embodiment.

Although the preferred embodiments of the present invention have been described above, the technical scope of the present invention is not limited to the above embodiments. The above embodiments can be variously modified and improved, and those modified and improved embodiments also fall within the technical scope of the present invention.

The present invention can be implemented in various types of devices discharging the liquid material and can be applied to, for example, the plunger type in which the liquid material is discharged by moving, through a desired distance, a plunger sliding within a storage container including a nozzle disposed at its tip while the plunger is held in close contact with an inner surface of the storage container, the screw type in which the liquid material is discharged with rotation of a screw, and the valve type in which desired pressure is applied to the liquid material and discharge of the liquid material is controlled by opening and closing a valve. The present invention provides a more significantly advantageous effect in a liquid material discharge device of the type in which the liquid material is applied by dripping the liquid material from a discharge port, which is opened downward, toward a workpiece that is positioned under the discharge port.

LIST OF REFERENCE SIGNS

1: discharge device, 2: substrate, 3: connecting portion (projected electrode, electrode pad), 4: liquid resin (liquid material), 5: semiconductor chip, 6: known discharge device, 10: stage, 11: workpiece, 12: discharge device main body, 13: nozzle member, 14: liquid chamber, 15: supply joint, 16: outlet joint, 17: piston chamber, 18: switching valve, 19: air supply source (19*a*, 19*b*, 19*c*), 20: pressure reducing valve (20*a*, 20*b*, 20*c*), 21 (21*a*, 21*b*): outlet port, 22, 23: tubing line, 24: storage container (storage tank), 25: liquid material, 26: pipe, 27: liquid feed tube, 28: supply flow path, 31: flow control valve, 32: on-off valve, 33: valve member, 34: piston, 35: valve seat, 36: spring, 37: retracted-position adjusting screw, 38: contact member, 40: temperature control device (heat-transfer temperature control device), 41: temperature control jacket, 42: heat shield member, 43: coolant flow path (heat-exchange flow path), 44: discharge hole, 45 (45*a*, 45*b*): wall, 46: coolant supply port, 47: coolant outlet port, 48 (48*a*, 48*b*): partition wall, 49: discharge-portion insertion opening, 50: discharge control device, 51: air dispenser, 52: pressure feed tube, 53: adapter, 54: storage container (syringe), 55: liquid feed member, 56: discharge member, 57: nozzle member, 58: discharge port, 60: circulation pump, 61: Peltier element, 62: heatsink, 63: temperature sensor, 64: communication tube, 65: communication hole, 70: heat shield member, 71: lower plate, 72: upper plate, 73: lower coolant flow path (lower heat-exchange flow path), 74: upper coolant flow path (upper heat-exchange flow path), 80: heat shield member, 81: infrared reflection layer, 82: heat insulating layer, 83: heat transfer layer, 84: infrared reflection layer, 90: heat shield member, 91: rising portion, 101: application device, 102: bench, 105: X drive device, 106: Y drive device, 107: Z drive device, 108: X moving direction, 109: Y moving direction, 110: Z moving direction, 111: drive control device, 112: cover, 120: temperature control device unit, 121: heat-shield temperature control device

The invention claimed is:

1. A liquid material discharge device comprising a discharge port, a liquid chamber in communication with the discharge port, and a discharge controller controlling a discharge operation, the liquid material discharge device discharging the liquid material from the discharge port while a workpiece and the discharge port are moved relative to each other, wherein the liquid material discharge device further comprises a heat-transfer temperature controller including a heat source to adjust a temperature of the liquid chamber, and a heat-shield temperature control device disposed between the heat-transfer temperature controller and the workpiece, and configured to adjust a temperature of the heat-transfer temperature controller, wherein the heat-shield temperature control device includes a heat-exchange flow path through which a heat-exchange fluid for controlling the temperature of the heat-transfer temperature controller flows.

2. The liquid material discharge device according to claim 1, wherein the heat-exchange flow path is disposed between the liquid chamber and the workpiece.

3. The liquid material discharge device according to claim 2, wherein the heat-transfer temperature controller includes a heat conduction member conducting heat from the heat source to the liquid chamber, and the heat conduction member is a temperature control jacket covering a periphery of the liquid chamber.

4. The liquid material discharge device according to claim 3, further comprising a nozzle member including the discharge port formed at a lower end thereof, wherein the temperature control jacket includes a discharge hole through which the nozzle member is inserted, or through which the discharge port and an outside are communicated with each other.

5. The liquid material discharge device according to claim 3, wherein a bottom surface of the temperature control jacket constitutes at least part of an inner wall of the heat-exchange flow path.

6. The liquid material discharge device according to claim 3, wherein the heat-shield temperature control device includes a heat shield member blocking radiant heat from the workpiece.

7. The liquid material discharge device according to claim 6, wherein the heat shield member reflects an infrared ray in a particular wavelength range.

8. The liquid material discharge device according to claim 6, wherein the heat shield member constitutes at least part of an inner wall of the heat-exchange flow path.

9. The liquid material discharge device according to claim 6, wherein the heat shield member has a bottom area equal to or larger than a bottom surface of the temperature control jacket and is disposed in a covering relation to the bottom surface of the temperature control jacket when viewed from the bottom surface side of the temperature control jacket.

10. The liquid material discharge device according to claim 6, wherein the heat shield member includes a rising portion covering a lateral surface of the heat-exchange flow path.

11. The liquid material discharge device according to claim 6, wherein an infrared reflection layer made of a metal surface reflecting an infrared ray in a particular wavelength range or a coating film surface reflecting the infrared ray in the particular wavelength range is formed at a bottom surface of the heat shield member.

12. The liquid material discharge device according to claim 6, wherein the heat shield member is made of a material having a higher thermal conductivity than a bottom surface of the temperature control jacket and includes a heat transfer layer constituting an inner wall of the heat-exchange flow path.

13. The liquid material discharge device according to claim 12, wherein the heat shield member includes a heat insulating layer disposed between the heat transfer layer and a bottom surface of the heat shield member and made of a material having a lower thermal conductivity than the bottom surface of the heat shield member.

14. The liquid material discharge device according to claim 13, wherein the heat insulating layer is made of resin.

15. The liquid material discharge device according to claim 6, wherein the heat shield member includes a plate member disposed with a gap interposed between the plate member and a bottom surface of the temperature control jacket, and the heat-exchange flow path is formed by the gap.

16. The liquid material discharge device according to claim 6, wherein the heat shield member includes a first plate member disposed with a gap interposed between the first plate member and a bottom surface of the temperature control jacket, and a second plate member disposed with a gap interposed between the second plate member and a bottom surface of the first plate member, and the heat-exchange flow path includes an upper heat-exchange flow path formed by a space between the bottom surface of the temperature control jacket and an upper surface of the first plate member, and a lower heat-exchange flow path formed by a space between the bottom surface of the first plate member and an upper surface of the second plate member.

17. The liquid material discharge device according to claim 16, wherein the heat shield member includes a communication tube through which a coolant is supplied to the lower heat-exchange flow path, and a communication hole through which the heat-exchange fluid having passed through the lower heat-exchange flow path is supplied to the upper heat-exchange flow path.

18. The liquid material discharge device according to claim 3, wherein an infrared reflection layer made of a metal surface reflecting an infrared ray in a particular wavelength range or a coating film surface reflecting the infrared ray in the particular wavelength range is formed at a bottom surface of the temperature control jacket.

19. The liquid material discharge device according to claim 3, wherein the heat-shield temperature control device includes a temperature sensor measuring a temperature of the temperature control jacket, and the discharge controller controls a flow rate of the heat-exchange fluid flowing through the heat-exchange flow path in accordance with a signal from the temperature sensor.

20. The liquid material discharge device according to claim 2, further comprising a heat-exchange fluid delivery device that supplies the heat-exchange fluid to the heat-exchange flow path.

21. The liquid material discharge device according to claim 20, wherein the heat-exchange fluid delivery device is constituted by a circulating pump supplying the heat-exchange fluid by circulating the heat-exchange fluid.

22. The liquid material discharge device according to claim 20, wherein the heat-exchange fluid delivery device is constituted by an air supply source supplying pressurized air.

23. The liquid material discharge device according to claim 1, further comprising a supply flow path through which the liquid material is supplied to the liquid chamber, wherein the heat-transfer temperature controller is disposed in a covering relation to the liquid chamber and the supply flow path.

24. The liquid material discharge device according to claim 1, further comprising a plunger including a tip portion that is narrower than the liquid chamber and that is disposed in the liquid chamber; and a plunger driver moving the plunger forward and backward, wherein the liquid material discharge device is a jet discharge device in which the liquid material is discharged in the form of flying droplets from the discharge port by causing the plunger moving forward to collide against a valve seat formed in an inner bottom surface of the liquid chamber, or by stopping the plunger moving forward immediately before colliding against the valve seat.

25. An application device comprising:

the liquid material discharge device according to claim 1;

a stage on which the workpiece is placed;

a heater heating the stage;

a relative moving driver moving the liquid material discharge device and the stage relative to each other; and a drive controller controlling the relative moving driver.

26. The application device according to claim 25, wherein the heater has an ability of heating the stage to temperature higher than a room temperature by 20° C. or more, and the heat-transfer temperature controller adjusts a temperature of the liquid chamber to be kept within a range of ±10° C. from the room temperature.

27. An application method using an application device comprising the liquid material discharge device according to claim 2, comprising:

a stage on which the workpiece is placed;

a heater heating the stage;

a relative moving driver moving the liquid material discharge device and the stage relative to each other; and a drive controller controlling the relative moving driver, wherein the heater has an ability of heating the stage to a temperature high than a room temperature by 20° C. or more, the heat-transfer temperature controller has an ability of adjusting the temperature of the liquid chamber to be kept within a range of ±10° C. from the room temperature, the heat-exchange fluid a coolant at a temperature not higher than the room temperature, and the liquid material is applied in a state in which the stage is heated by the heater to the temperature higher than the room temperature by 20° C. or more.

28. An application method using the liquid material discharge device according to claim 1, the application method comprising:

a first application step of performing first application under a first temperature environment; and a second application step of performing second application under a second temperature environment that is different in temperature from the first temperature environment by 10° C. or more.

29. An application method using the application device according to claim 25, the application method comprising:

a step of performing first application on the stage under heating; and a step of performing second application outside the stage.

30. The liquid material discharge device according to claim 1, wherein the heat-transfer temperature controller directly contacts the liquid chamber to conduct heat from the heat source to the liquid chamber.

* * * * *